US005872428A

United States Patent [19]

Carr

[11] Patent Number: 5,872,428

[45] Date of Patent: Feb. 16, 1999

[54] CAVITY COUPLING MEANS ROTATABLE IN RESPONSE TO LINEAR MOVEMENT OF AN ACTUATOR

[75] Inventor: David Ward Carr, Chelmsford, Great Britain

[73] Assignee: EEV Limited, Chelmsford, United Kingdom

[21] Appl. No.: 783,295

[22] Filed: Jan. 10, 1997

[30] Foreign Application Priority Data

Jan. 31, 1996 [GB] United Kingdom ..... 9601926
Nov. 12, 1996 [GB] United Kingdom ..... 9623490

[51] Int. Cl.[6] ..... H01J 23/22; H01J 23/46; H01J 25/00

[52] U.S. Cl. ..... 315/5; 333/230

[58] Field of Search ..... 315/4, 5; 333/230, 333/232, 24 R

[56] References Cited

U.S. PATENT DOCUMENTS

| | | | |
|---|---|---|---|
| 2,606,307 | 8/1952 | Pease et al. | 333/233 X |
| 4,642,523 | 2/1987 | Nakanishi et al. | 333/230 X |
| 4,740,764 | 4/1988 | Gerlack | 333/26 |
| 5,122,390 | 6/1992 | Rearick et al. | 427/117 |
| 5,305,000 | 4/1994 | Harris | 343/786 |
| 5,625,330 | 4/1997 | Wilson et al. | 333/230 |

FOREIGN PATENT DOCUMENTS

| | | | |
|---|---|---|---|
| 945707 | 7/1956 | Germany . | |
| 599700 | 5/1948 | United Kingdom . | |
| 606347 | 8/1948 | United Kingdom | 333/232 |
| 820161 | 9/1959 | United Kingdom . | |
| 1028229 | 5/1966 | United Kingdom . | |
| 2244854 | 12/1991 | United Kingdom . | |

OTHER PUBLICATIONS

UK Search Report dated Jun. 4, 1996 GB Application No. 9601926.0.
UK Search Report dated Mar. 18, 1996 GB Application No. 9600491.6.
European Search Report dated Apr. 16, 1998.

*Primary Examiner*—Benny T. Lee
*Attorney, Agent, or Firm*—Donald C. Casey, Esq.

[57] ABSTRACT

An actuator for rotation of coupling means such as a loop in a high frequency resonant cavity includes a rotatable member to which the loop is fixed and a rod located adjacent it. The member and rod have interengaging teeth such that when the rod is moved inwardly or outwardly by an operator it causes the member, and hence the loop, to rotate. This is a compact assembly having components which are simple and easy to facilitate. In a preferred embodiment, the rod is located in a groove in the cavity wall.

12 Claims, 3 Drawing Sheets

CAVITY COUPLING MEANS ROTATABLE IN RESPONSE TO LINEAR MOVEMENT OF AN ACTUATOR

FIELD OF THE INVENTION

This invention relates to an actuator for rotation of coupling means and more particularly, but not exclusively, for controlling rotation of coupling means located in a high frequency resonant cavity located adjacent another such cavity.

BACKGROUND OF THE INVENTION

In microwave or high frequency devices in which high frequency energy is coupled from a resonant cavity or into such a cavity, it is often a requirement that the degree of coupling into or out of the cavity is adjustable by rotating a coupling loop or other coupling means located within the cavity. This adjustment is normally carried out manually. In a known adjustment arrangement, a coupling loop to be rotated is fixed to a ceramic disc having a raised metal rim. The disc is located in an aperture in the cavity wall and is rotatable relative to the wall. An endless drive belt passes over the metal rim to a knob rotatably secured to the cavity wall and positioned to be accessible to an operator. When the operator turns the knob, the drive belt transmits this movement to the rotatable disc and hence to the coupling loop. To allow rotation of the disc, there is a gap between its metal rim and the surrounding metal cavity wall. Metal spring fingers are located around the edge of the metal rim and press against the wall of the aperture in the cavity wall to prevent leakage of high frequency radiation through the gap. Such an arrangement can be used to provide adjustment of a coupling loop in a single cavity or by a suitable mechanical connection to loops in different adjacent resonant cavities. If independent control of the orientations of coupling loops in adjacent cavities is required, then two sets of adjusting knobs and drive belts are provided.

The present invention seeks to provide an improved actuator for providing rotation of coupling means in a high frequency resonant cavity.

SUMMARY OF THE INVENTION

According to the invention there is provided an actuator for rotation of coupling means in a high frequency resonant cavity comprising a rotatable member connected to the coupling means and an elongate rod, the member and rod having interengaging portions such that linear movement of the rod results in rotation of the member whereby the coupling means is rotated.

By employing the invention, an actuator may be provided which may be particularly compact compared to the known previous arrangement. Often equipment using such resonant cavities must be able to fit into restricted spaces and any saving in the volume required may be important in gaining commercial acceptance. The rod may need only be of sufficiently large transverse cross-sectional area to allow satisfactory engagement with the rotatable member and transmit the mechanical movement. In the more bulky conventional arrangement the manually adjustable knob must have a surface over which the drive belt pass and also a projecting part to allow the operator to turn it. There must also be sufficient clearance for the knob to be accessible to the operator's fingers or hand. In contrast, in the present invention the rod is moved linearly in and out to rotate the member and hence the coupling means. No turning action is required of the operator and hence the space requirement is reduced. The end of the rod may be made to project beyond the cavity wall so that in some configurations no allowance at all need be made for access by the operator's hand into the space bounded by the cavity wall. Also, in the previously known construction, an operator may find it awkward to rotate the knob because of its location and the turning movement of the hand required. In the present invention, only a linear movement is required by the operator as he pushes the rod in or pulls it out. This may lead to improved precision and speed in adjusting the coupling.

Another advantage is that an actuator in accordance with invention may be made from fewer parts which are also less complex than the conventional arrangement. For example, there is no need to provide a metal rim to the rotatable member to give a surface for a drive belt and hence no need to bridge the gap between the rim and surrounding cavity wall with spring fingers. The elimination of the drive belt also gives a more direct mechanical connection.

In one particularly advantageous embodiment of the invention, the cavity wall in which the rotatable member is mounted includes a groove in which the rod is arranged to move, reducing further the space required by the actuator. The rod may be made flush with the outer surface of the cavity defining wall or may project somewhat from the groove. This arrangement therefore allows adjacent different resonant cavities to be implemented having a wall which is common to both cavities and in which the rod is located in a groove in the common wall. Alternatively, adjacent cavities may have separate facing cavity defining walls with the rod being arranged to lie between them or located in grooves in one or both of them. A single actuator may be used to control the orientation of coupling means in the two cavities or two actuators may be may be included to give independent control of the coupling means.

Preferably, the rod is of circular or square cross-sectional shape, for example. However, in other arrangements, the rod could have a significantly larger width in one direction but this tends to increase the cost of the materials required and greater space is required to accommodate the rod. The rod may be of metal, plastic or some other suitable material. The rod is usually straight but in some applications it could have a curved shape, for example.

In an advantageous embodiment of the invention, a locking mechanism is included to hold the rod and hence the coupling loop in a particular selected position or positions.

The interengaging portions of the rotatable member and rod may be teeth carried by each component and which intermesh. Alternatively one component may, say, have projections which engage with apertures in the other, or one or both of the rotatable member and rod may have high friction surfaces or coatings, with no projecting parts, and the high friction material provides the necessary interengagement.

According to a first feature of the invention, there is provided a cavity arrangement comprising a high frequency resonant cavity, coupling means located in the cavity and an actuator in accordance with the invention for rotation of the coupling means.

According to a second feature of the invention, there is provided a cavity arrangement comprising two high frequency resonant cavities located adjacent one another and an actuator in accordance with the invention located between them and arranged to rotate coupling means in at least one of the cavities.

According to a third feature of the invention there is provided a linear electron beam tube apparatus comprising an electron beam tube, a high frequency resonant cavity at which energy is coupled into or out of the tube and including rotatable coupling means located in the cavity, and an actuator in accordance with the invention for rotating the coupling means. The invention may be applied advantageously to inductive output tubes (IOTs) or klystrons, for example.

BRIEF DESCRIPTION OF DRAWINGS

Some ways in which the invention may be performed are now described by way of example with reference to the accompanying drawings in which.

DESCRIPTION OF PREFERRED EMBODIMENTS

Figure 1:
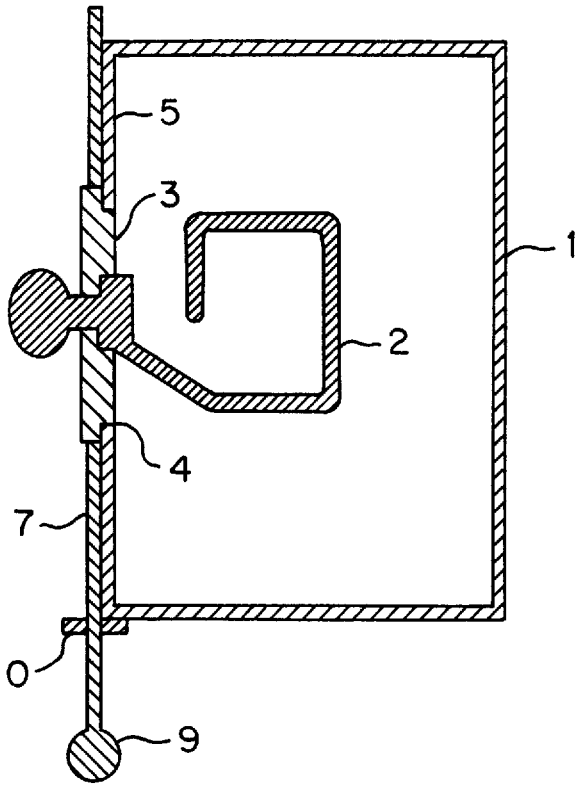
FIG. 1 is a schematic sectional view of an actuator in accordance with the invention.
Figure 2:
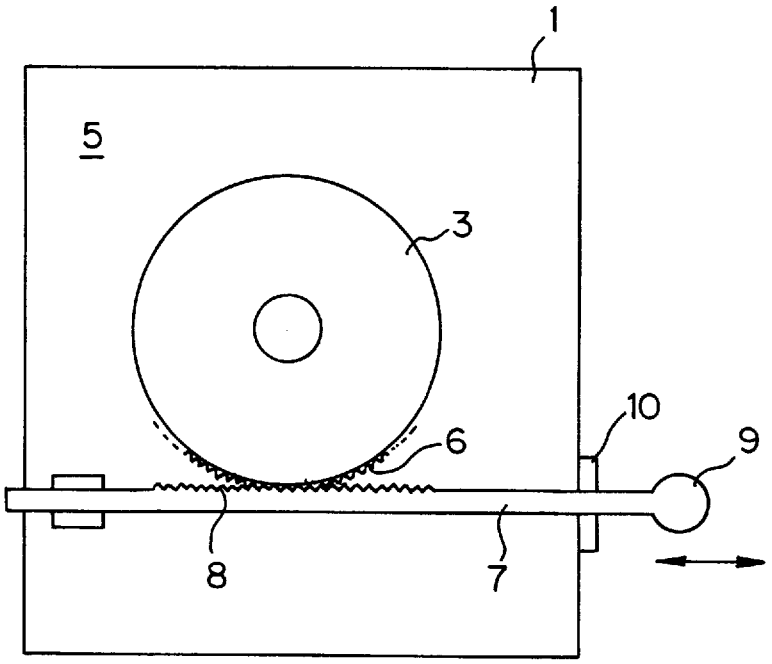
FIG. 2 is a side view of the arrangement shown in FIG. 1.

With reference to FIGS. 1 and 2, a high frequency resonant cavity 1 used in a klystron or IOT output cavity circuit includes a coupling loop 2 located within the cavity for extracting energy therefrom. The loop 2 is fixed in a ceramic disc 3 which in turn is located in an aperture 4 (see FIG. 1) in a wall 5 of the resonant cavity 1. The disc 3 is rotatable in the aperture 4 and has a plurality of teeth 6 (see FIG. 2) around its outer circumference located outside the resonant cavity 1. A metal or plastic rod 7 is positioned next to the disc 3 and also includes a plurality of teeth 8 (see FIG. 2) on one of its surfaces which are arranged to interengage with those of the disc 3. The rod 7 projects beyond the resonant cavity and terminates in a knob 9. A locking mechanism 10 also serves to guide the rod.

When it is wished to rotate the loop 2, an operator pushes in the rod 7 or pulls it out as desired in a linear movement as shown by the arrow. This causes the teeth 8 to bear on the teeth 6 on the ceramic disc 3 which rotates, and hence the loop 2 rotates. When the correct orientation is attained, the rod 7 is locked in position using the locking mechanism 10.

Figure 3:
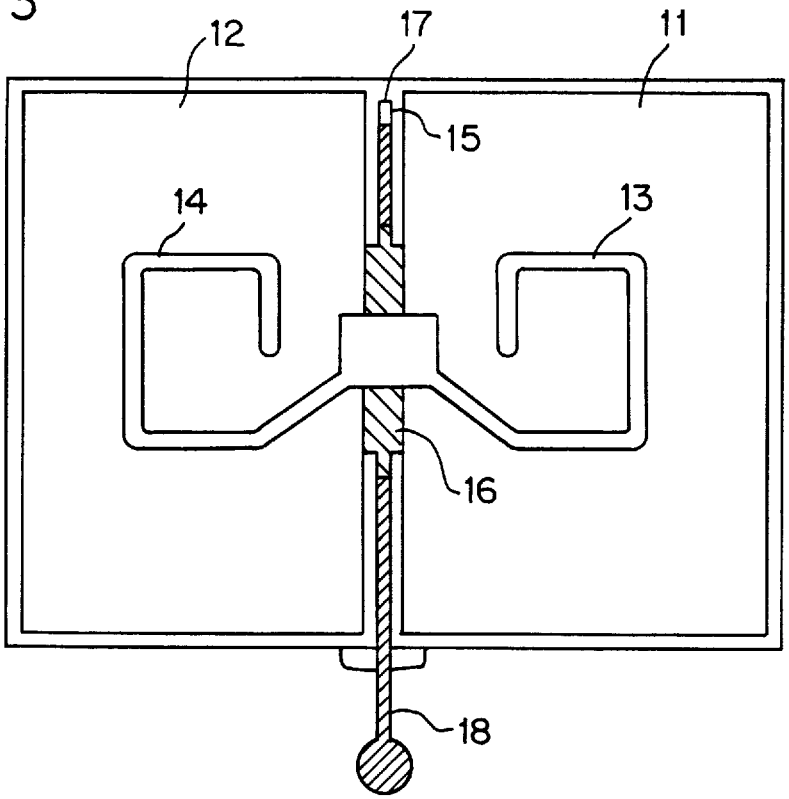
FIG. 3 is a schematic sectional view of a cavity arrangement which includes two resonant cavities.

In another arrangement in accordance with the invention shown in FIG. 3, two resonant cavities 11 and 12 are located adjacent one another. Each cavity includes a respective coupling loop 13 and 14 which are connected together to give fixed orientation relative to one another. The cavities 11 and 12 have a common wall 15 through which the connection between the loops 13 and 14 extends. A ceramic disc 16 is located in a recess in the wall 15 and is rotatable therein, the loops 13 and 14 being mounted in it. A groove 17 passing through the common wall 15 allows an actuator rod 18 to be located adjacent the ceramic disc 16. Interengaging portions on the disc 16 and rod 18 allow rotation of the disc 16, and thus the loops 13 and 14, when the rod 18 is moved inwardly or outwardly.

Figure 4:
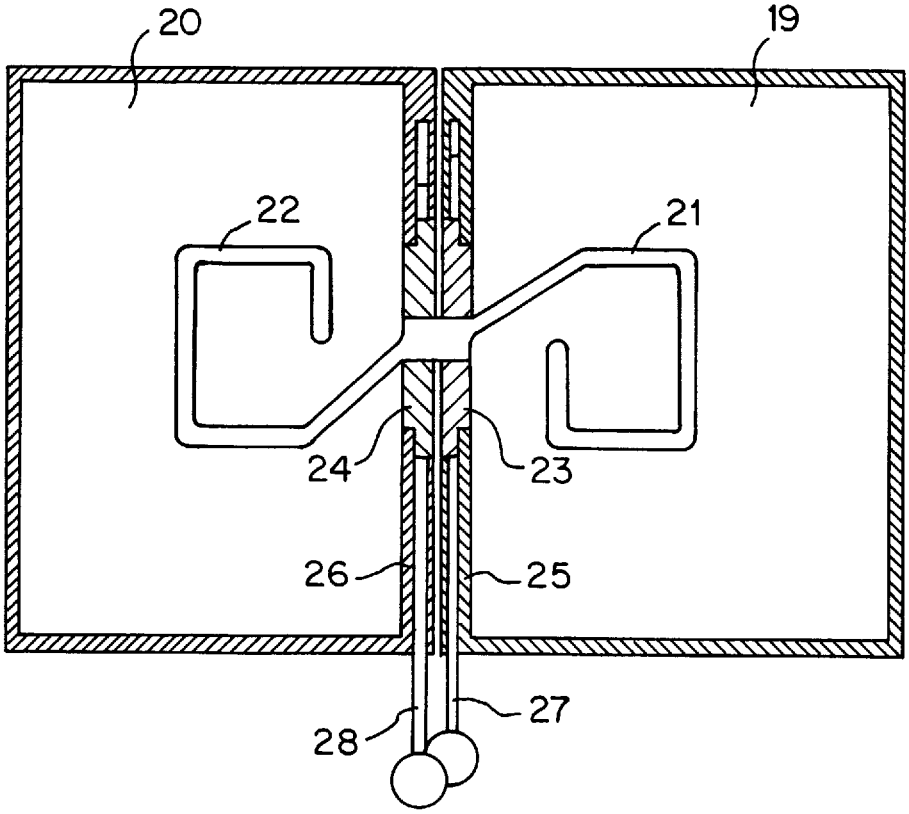
FIG. 4 schematically shows another cavity arrangement.

FIG. 4 illustrates another arrangement including two resonant cavities 19 and 20. The coupling loops 21 and 22 located within the respective cavities 19 and 20 are independently rotatable. Each of them is associated with a respective rotatable member 23 and 24 located in apertures in the corresponding facing cavity walls 25 and 26. Actuator rods 27 and 28 are located in grooves in the walls 25 and 26 respectively and are arranged to cause rotation of the discs 23 and 24 when moved to control to the rotation of the loops 21 and 22.

Figure 5:
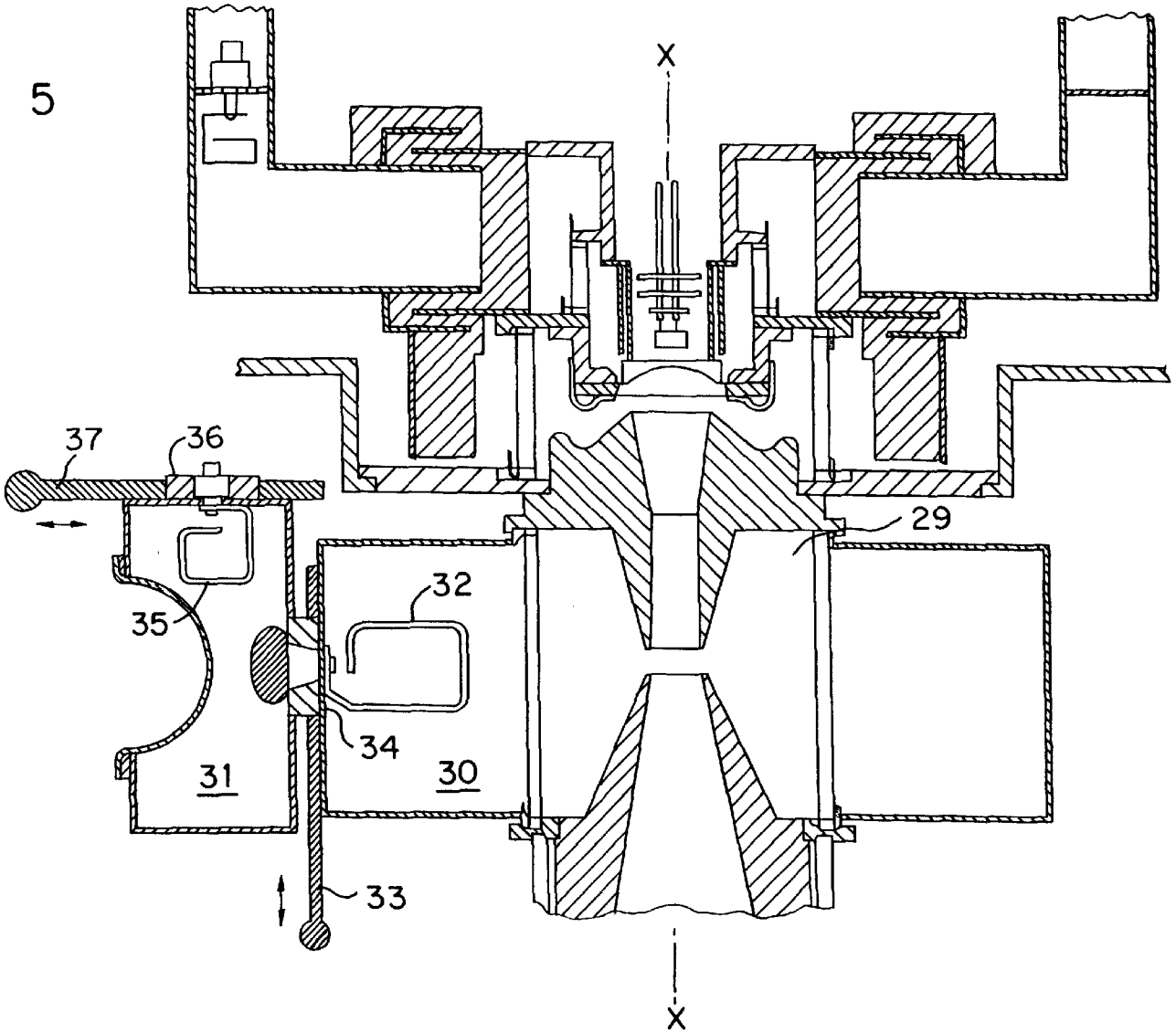
FIG. 5 schematically illustrates an IOT in accordance with the invention.

FIG. 5 schematically illustrates an inductive output tube (IOT) arrangement having a double output cavity circuit 29 with a primary resonant cavity 30 and a secondary cavity 31. A coupling loop 32 delivers energy from the primary cavity 30 into the secondary cavity 31 and is rotatable by means of an actuator having a rod 33 and a rotatable member 34 with meshing teeth. By pushing the rod 33 inwardly, the member 34 rotates and hence alters the orientation of the loop 32. A second coupling loop 35 located in the secondary cavity 31 is used to extract the amplified output signal from the secondary cavity 31. This loop 35 is also connected to be rotatable via a disc 36 by movement of a rod 37 inwardly or outwardly to adjust the degree of coupling.

I claim:

1. An actuator for rotation of coupling means in a high frequency resonant cavity, said coupling means having an axis, said actuator comprising: a rotatable member connected to said coupling means and an elongate rod, said member and said rod having interengaging portions such that linear movement of said rod results in rotation of said member whereby said coupling means is rotated about said axis.

2. An actuator as claimed in claim 1 wherein said coupling means comprises a coupling loop.

3. An actuator as claimed in claim 1 further including locking means for locking said rod in a selected position.

4. An actuator as claimed in claim 1 wherein said high frequency resonant cavity includes a wall, a groove being defined in said wall, said rod being located in said groove.

5. An actuator as claimed in claim 4 wherein said groove is in an outer surface of said wall of said cavity in which said coupling means is located.

6. An actuator as claimed in claim 1 wherein said rotatable member comprises a ceramic disc located in an aperture in a wall of said resonant cavity.

7. A cavity arrangement comprising a high frequency resonant cavity, coupling means having an axis and being located in said cavity and an actuator for rotation of said coupling means about said axis, said actuator comprising a rotatable member for rotation of said coupling means in a said high frequency resonant cavity and an elongate rod, said rotatable member and said rod having interengaging portions Such that linear movement of said rod results in rotation of said member whereby said coupling means is rotated about said axis.

8. A cavity arrangement comprising two high frequency resonant cavities located adjacent one another and at least one actuator comprising a rotatable member connected to corresponding high frequency coupling means located in at least one of said two cavities and an elongate rod located between said two cavities, said member and said rod having interengaging portions, such that linear movement of said rod results in rotation of said member whereby said corresponding coupling means is rotated.

9. An arrangement as claimed in claim 8 and said at least one actuator comprising two actuators arranged to allow independent rotation of said corresponding coupling means located in said at least one of said two cavities.

10. An arrangement as claimed in claim 8 wherein said two cavities have a common wall in which said rotatable member is mounted.

11. An arrangement as claimed in claim 10 and wherein a groove is included in said common wall and said rod is located therein.

12. A linear electron beam tube apparatus comprising an electron beam tube, including a high frequency resonant cavity arranged for coupling energy into or out of said tube, rotatable coupling means located in said cavity and having an axis, and an actuator for rotating said coupling means about said axis comprising a rotatable member connected to said coupling means and an elongate rod, said member and said rod having interengaging portions such that linear movement of said rod results in rotation of said member whereby said coupling means is rotated about said axis.

* * * * *